US008776407B2

(12) United States Patent
Haines

(10) Patent No.: US 8,776,407 B2
(45) Date of Patent: Jul. 15, 2014

(54) WEAR PART

(76) Inventor: Norman Graham Haines, Aitkenvale (AU)

( * ) Notice: Subject to any disclaimer, the term of this patent is extended or adjusted under 35 U.S.C. 154(b) by 447 days.

(21) Appl. No.: 13/054,630

(22) PCT Filed: Jul. 20, 2009

(86) PCT No.: PCT/AU2009/000924

§ 371 (c)(1),
(2), (4) Date: Mar. 16, 2011

(87) PCT Pub. No.: WO2010/006382

PCT Pub. Date: Jan. 21, 2010

(65) Prior Publication Data

US 2011/0154697 A1 Jun. 30, 2011

(30) Foreign Application Priority Data

Jul. 18, 2008 (AU) ..... 2008203208

(51) Int. Cl.
*E02F 9/28* (2006.01)

(52) U.S. Cl.
USPC ..... 37/453

(58) Field of Classification Search
CPC ..... E02F 3/40; E02F 3/962; E02F 3/963; E02F 9/28; E02F 9/2875; E02F 9/2825; E02F 9/2833; E02F 9/2858
USPC ..... 37/446, 452–456; 172/699, 700, 750, 172/713, 721, 730, 753, 765, 769–772.5, 172/719, 701.2, 701.3, 745, 749
See application file for complete search history.

(56) References Cited

U.S. PATENT DOCUMENTS

| | | | | |
|---|---|---|---|---|
| 3,063,176 | A | 11/1962 | Larson | |
| 3,190,379 | A * | 6/1965 | Troeppl et al. | 175/385 |
| 4,085,530 | A * | 4/1978 | Landry | 37/446 |
| 4,117,611 | A * | 10/1978 | Hemphill | 37/452 |
| 4,175,341 | A * | 11/1979 | Mortimore | 37/301 |
| 5,188,680 | A * | 2/1993 | Hahn et al. | 148/593 |
| 6,401,834 | B1 * | 6/2002 | Yeomans | 172/701.3 |
| 2004/0060208 | A1 | 4/2004 | Wagner | |

FOREIGN PATENT DOCUMENTS

| | | |
|---|---|---|
| GB | 647746 | 12/1950 |
| GB | 2 132 980 A | 7/1984 |
| JP | 2000-160605 | 6/2000 |

OTHER PUBLICATIONS

International Search Report issued in PCT/AU2009/000924 on Oct. 29, 2009.

* cited by examiner

*Primary Examiner* — Robert Pezzuto
(74) *Attorney, Agent, or Firm* — Stein IP, LLC

(57) ABSTRACT

A wear part including an attachment box with a forwardly extending ground engaging blade member having an upper surface and an extension rib extending upwardly from one lateral side of the upper surface of the blade member and extending substantially parallel to the direction of ground engagement.

22 Claims, 5 Drawing Sheets

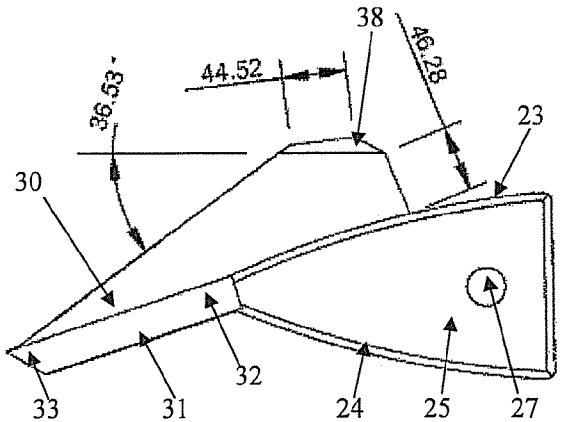
Figure 14
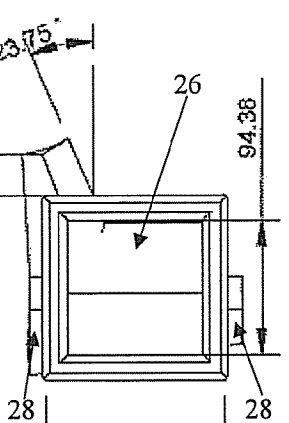
Figure 13
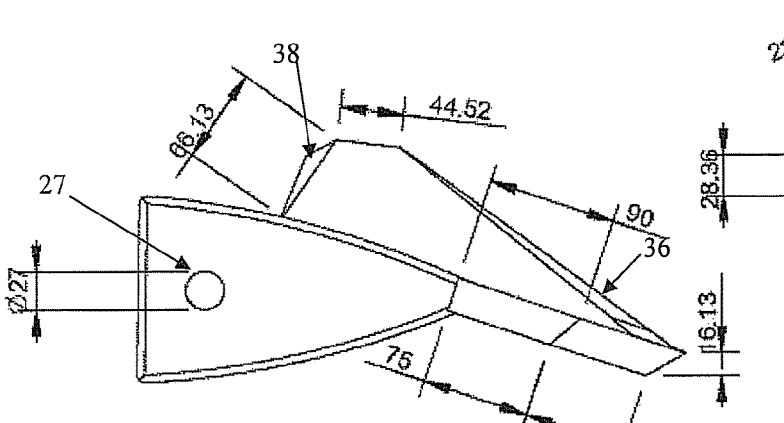
Figure 12
Figure 16
Figure 15

WEAR PART

FIELD OF THE INVENTION

The present invention relates to wear parts for earthmoving equipment and particularly for an improved tooth for use with earthmoving equipment.

BACKGROUND ART

Wear parts and particularly attachable teeth for earthmoving equipment are available.

One such example of an attachable tooth used for earthmoving equipment is illustrated in FIGS. 1 and 2. This attachable tooth 10 has an attachment box 11 or section at the rear of the tooth 10 with a circular openings 12 in the sidewalls 13 of the box 11 extending laterally therethrough to receive a pin 14 or similar in order to attach the tooth 10 to a mounting portion 15 on the earthmoving equipment.

The attachment box 11 of the prior art tooth 10 is reinforced for added strength, particularly around the openings 12 in the sidewalls 13 of the box section.

The attachable tooth 10 also has a forwardly extending blade portion 16. The blade portion 16 has a centrally aligned rib 17 with the rippled surfaces 19 in between the rib 17 and the sidewalls 18 of the blade portion 16. The rippled surfaces 19 are apparently to optimise penetration and material flow over the tooth 10. This is ostensibly to improve the self sharpening effect of the tooth as the tooth is worn.

Although not visible in the Figures, the underside of the blade portion of the tooth of the prior art has a pocket or depression which the inventors of the prior art tooth contend maintains tip sharpness without compromising point integrity.

The tooth is attached to a mounting portion 15 located on the earthmoving equipment as illustrated in FIG. 3.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a wear part, which may at least partially overcome at least one of the abovementioned disadvantages or provide the consumer with a useful or commercial choice.

With the foregoing in view, the present invention in one form, resides broadly in a wear part including an attachment box with a forwardly extending ground engaging blade member having an upper surface and an extension rib extending upwardly from one lateral side of the upper surface of the blade member and extending substantially parallel to the direction of ground engagement.

In a further form, the present invention resides in a wear part including an attachment box with a forwardly extending ground engaging blade member having an upper surface substantially coplanar with the upper surface of the attachment box and a lower surface substantially parallel to the upper surface.

The wear part of the present invention is directed towards providing a more angular tooth than the teeth used conventionally. The more angular nature of the tooth of the present invention provides advantages in the "angle of attack" of the tooth in use and also provides a tooth which, as it wears due to use, maintained its overall shape and particularly tip sharpness. The tooth of the present invention is also self sharpening as it undergoes wear.

The wear part of the present invention will typically be configured as an attachable tooth common typically used in association with earthmoving equipment such as an earthmoving bucket or loader but preferably as a tooth for an earthmoving grader.

As intimated above, teeth used in this manner are subject to wear and as a tooth does wear, the shape of the tooth normally changes. It is an advantage therefore for a tooth which does wear to maintain as much as possible the overall shape and in particular the sharpened tip.

The wear part of the present invention includes an attachment box. In use, the attachment box is used to attach to the wear part relative to the earthmoving equipment, and typically an attachment mount is provided specifically adapted for this purpose. The attachment mounts of earthmoving equipment are typically provided in standard sizes and configurations in order that replacement wear parts can be provided and can be quickly and simply exchanged for worn or unusable parts.

The attachment box of the wear part of the present invention typically has an upper wall, an opposed lower wall and a pair of the sidewalls, these walls together defining an opening into which the attachment mount will be received in use.

Preferably, the upper and lower walls of the attachment box taper towards each other as they extend towards the blade portion of the wear part. The sidewalls of the attachment box are typically parallel to one another. As outlined above, the attachment box is typically adapted to receive a "standard" sized mounting portion therein and a substantially rectangular opening is provided via the rear most edges of the walls.

An opening is preferably provided in each of the sidewalls of the attachment box of the present invention. The respective openings are normally provided about central axis. These openings are typically adapted to receive a pin or other fastener therethrough in order to attach the wear part to the mounting portion.

It is preferred that the upper and/or lower walls of the attachment box of the present invention are arcuate or curved. It is particularly preferred that both of the upper and lower walls are convex.

The wear part of the present invention also has a forwardly extending, ground engaging blade member. In a preferred form, the blade member is generally rectangular in shape and has an upper surface, a lower surface, a pair of sidewalls, and a forward or leading surface. The blade member will typically be fondled integrally with the attachment box and therefore, will not have a rear wall or surface.

According to a preferred embodiment, the blade member of the wear part is typically wider than the sidewalls of the attachment box. Due to this extra width, a pair of lateral shoulder portions will normally be formed between the attachment box and the blade member.

According to a particularly preferred embodiment, the forward or leading surface of the blade member is angled to provide a "sharpened" forward edge. Normally, the forward surface is angled rearwardly from the upper surface to the lower surface. In use, the sharpened forward edge will typically be approximately parallel to the ground surface when attached to the mounting portion.

The forward or leading edge of the blade member is also angled rearwardly from one sidewall to the opposite side in order to form a leading tip or point. Normally the leading tip or point will be located at the intersection of the upper surface, a sidewall and the angled forward or leading surface of the blade member. The leading edge of the blade member is therefore angled rearwardly from one side to the other with respect to the attachment box.

Put another way, the forward surface of the blade member of the present invention is angled rearwardly and downwardly and also is not perpendicular to the sidewalls of the blade member but instead is angled rearwardly from one sidewall to another.

Further, the lower surface of the blade member will preferably be substantially parallel to the upper surface of the blade member. The blade member will preferably be solid and manufactured from a metal.

According to a particularly preferred embodiment, a uniform thickness blade member extending from a forward portion of the attachment box and integrally formed therewith is provided, the blade member having an upper surface coplanar with the upper surface of the attachment box and the lower surface of the blade member parallel to the upper surface of the blade member rather than coplanar with the lower wall of the attachment box.

This is in direct contrast with the prior art blade member, one form of which is illustrated in FIGS. 1 and 2 in which the blade member is solid and tapers from the front of the attachment box to the tip, with the lower wall of the blade member coplanar with the lower wall of the attachment box and the upper wall of the blade member coplanar with the upper wall of the attachment box. Further, the prior art blade member has a "square" tip.

The wear part of the present invention also has an extension rib, preferably standing proud of the upper surface of the blade member. The extension rib will typically extend upwardly from a location between one side of the blade member and the midline of the blade member. According to a preferred embodiment, the extension rib will typically extend substantially (although not exactly) parallel to a sidewall of the blade member.

The extension rib is typically integrally formed with the blade member with a base portion of the extension rib spaced from the side wall of the blade member.

The extension rib may preferably be angled such that the upper surface of the extension rib is offset from the base portion laterally resulting in a portion of the extension rib overhanging the sidewall of the blade member. The extension rib will typically extend rearwardly from adjacent the forward edge of the blade member and a rear wall of the extension rib will normally be located above the upper wall of the attachment box.

According to alternative preferred embodiment of the present invention, there may be one of two embodiments of extension rib provided.

The first preferred embodiment is an extension rib which is preferably adapted for use in situations where the wear part is used for dirt and other normal earthmoving. The extension rib of this embodiment has an upper surface which is preferably angled with respect to the upper surface of the blade, namely the extension rib increases in thickness/height as it extends from the tip of the blade member towards the root of the blade member.

Accordingly, when viewed from the side, the extension rib of this embodiment is typically wedge-shaped. The extension rib of this embodiment will preferably be provided with one or more faceted rear walls, typically more than one with the surfaces of the rear walls extending in different directions, at different angles.

Preferably, the upper surface of the extension rib of this embodiment is angled downwardly towards the upper surface of the blade member at the tip end of the rib, that angle becoming less prominent towards the rear of the extension rib, and more parallel to the upper surface of the blade member.

The rear of the extension rib is preferably spaced further inwardly toward the midline of the blade than the tip of the extension rib. That is, the extension rib extends rearwardly at an angle across the blade. Typically, the angle is acute.

Typically, the extension rib of this embodiment is of substantially uniform thickness.

The second preferred embodiment is an extension rib which is preferably adapted for use in situations where the wear part is used for earthmoving in situations where it is likely that the wear part will strike trees and other above ground clearable rubble.

According to this embodiment, the extension rib has a forward surface, a rear surface, an outer and an inner surface and a top surface with the base of the extension rib formed integrally with the blade member.

The upper surface of the extension rib of this embodiment is preferably substantially parallel to the upper surface of the blade member. Preferably, the upper surface of the extension rib is twisted such that the root end of the upper surface is angled downwardly towards the upper surface of the blade to a larger degree than the upper surface at the tip end.

The extension rib on this embodiment is preferably block shaped (rectangular) when viewed from the side. Normally, the rear surface will be angled rearwardly from the upper surface to the attachment box. Further, the extension rib of this embodiment is typically of uniform thickness over its length.

Normally, the tip end of the extension rib of this embodiment is sharpened. The forward end, that is the edge at the intersection of the forward surface and the upper surface of the extension rib preferably extends forwardly of the forward edge of the blade member.

Preferably, the outer forward edge of the extension rib extends downwardly and rearwardly to the blade member. It is also preferred that the inner forward edge is located behind the outer forward edge or closer to the blade member. Further, the upper forward edge is preferably located in front of the lower forward edge.

The result of the above edge configurations is that the extension rib of this embodiment forms a forward point and a sharpened, forward, outer edge on the extension rib. Typically, the rear surface of the extension rib of this embodiment is substantially parallel to the forward surface.

Typically, a plurality of wear parts will be mounted relative to a piece of earthmoving equipment such as a bucket or grader or the like and all will typically be of a similar configuration.

BRIEF DESCRIPTION OF THE DRAWINGS

Various embodiments of the invention will be described with reference to the following drawings, in which:

FIG. 12 is a view from one side of the attachment tooth illustrated in FIG. 4.

FIG. 13 is a view from the attachment box end of the attachment tooth illustrated in FIG. 4.

FIG. 14 is a view from the reverse side of the attachment tooth illustrated in FIG. 4.

FIG. 15 is a view from one side of the attachment tooth illustrated in FIG. 5.

FIG. 16 is a view from the attachment box end of the attachment tooth illustrated in FIG. 5.

FIG. 17 is a view from the reverse side of the attachment tooth illustrated in FIG. 5.

DETAILED DESCRIPTION OF THE PREFERRED EMBODIMENT

According to a particularly preferred embodiment, a grader tooth 10 is provided.

The grader tooth 20 of both illustrated embodiments includes an attachment box 21 and a forwardly extending blade member 22.

Figure 1:
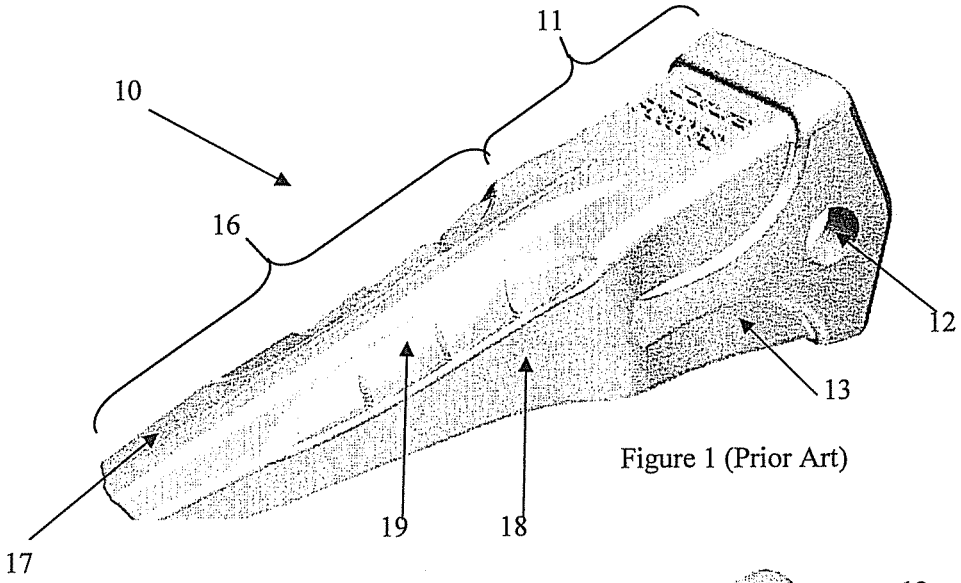
Figure 1 (Prior Art)
FIG. 1 is a perspective view from the front of a conventional wear part.
Figure 2:
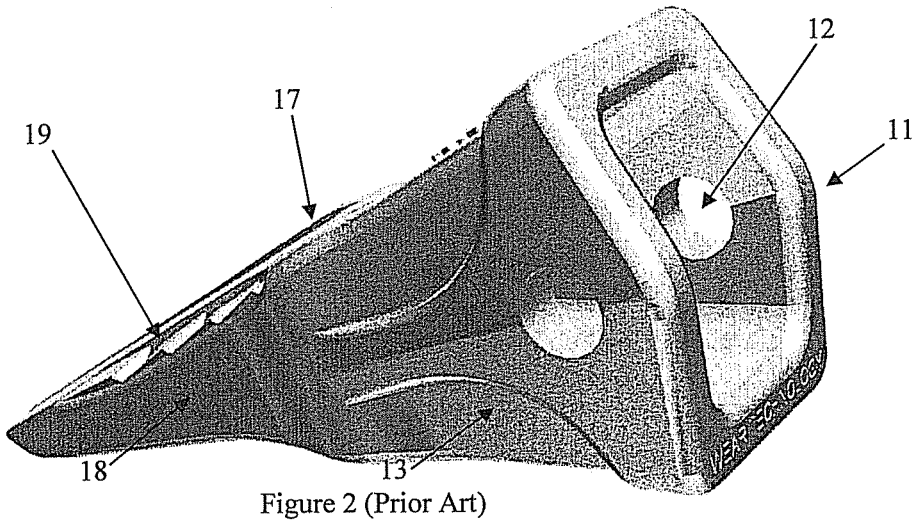
Figure 2 (Prior Art)
FIG. 2 is a perspective view from the rear of a conventional wear part.
Figure 3:
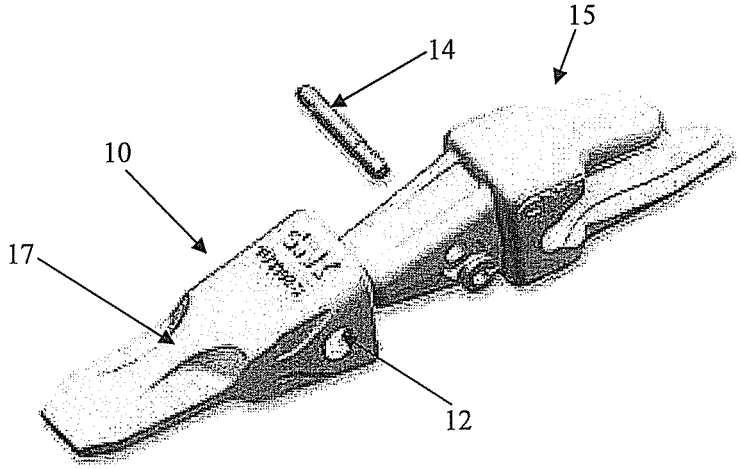
Figure 3 (Prior Art)
FIG. 3 is a perspective view of a conventional tooth and the attachment arrangement to attach the tooth to equipment.

In use, the attachment box 21 is used to attach to the tooth 20 relative to the earthmoving equipment, and typically an attachment mount is provided specifically adapted for this purpose as is generally illustrated in FIG. 3.

The attachment box 21 of each of the illustrated embodiments has an upper wall 23, and opposed lower wall 24 and a pair of the sidewalls 25, these walls together defining an opening 26 into which the attachment mount (not shown) is received in use.

The upper 23 and lower 24 walls of the attachment box 21 are arcuate and taper towards each other as they extend towards the blade portion 22 of the tooth. The sidewalls 25 of the attachment box 21 are parallel to one another. As outlined above, the attachment box 21 is adapted to receive a mounting portion therein and a substantially rectangular opening 26 is provided via the rear most edges of the walls.

An opening 27 is provided in each of the sidewalls of the attachment box 21 adapted to receive a pin or other fastener therethrough in order to attach the tooth to the mounting portion.

The blade member 22 is generally rectangular in shape and has an upper surface 30, a lower surface 31, a pair of sidewalls 32, and a forward or leading surface 33. The blade member 22 is formed integrally with the attachment box 21 and therefore, does not have a rear wall or surface, instead having a blade root.

According to the embodiments illustrated, the blade member 22 of the tooth is wider than the sidewalls of the attachment box 21. Due to this extra width, a pair of lateral shoulder portions 28 are formed between the attachment box 21 and the blade member 22.

The forward or leading surface 33 of the blade member 22 is angled to provide a "sharpened" forward edge 29. The forward surface 33 of the blade member 22 is angled rearwardly from the upper surface 30 to the lower 31 surface. In use, the sharpened forward edge 29 is approximately parallel to the ground surface when attached to the mounting portion.

Figure 6:
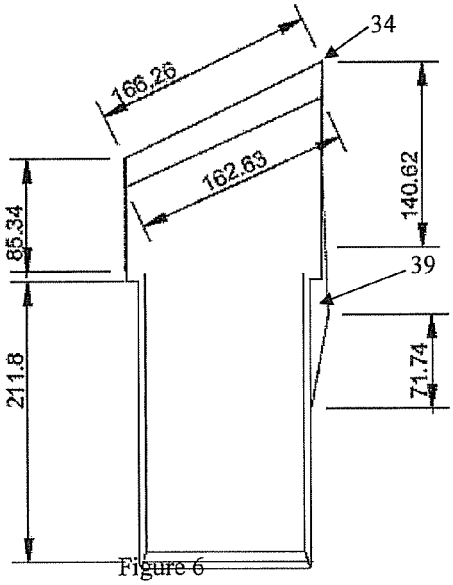
FIG. 6 is a view from below of the attachment tooth illustrated in FIG. 4.
Figure 9:
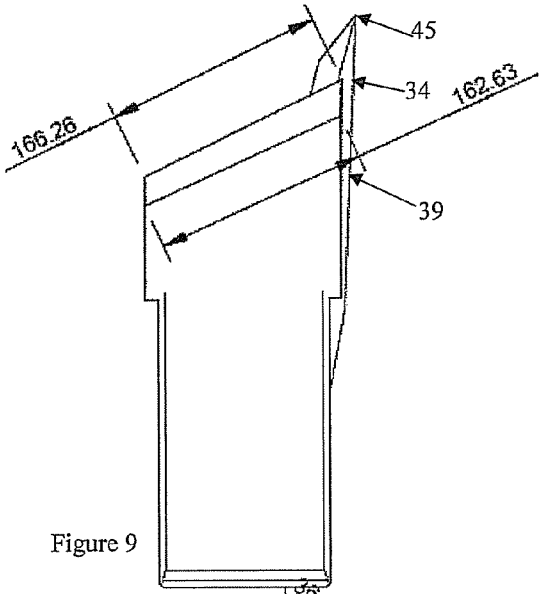
FIG. 9 is a view from below of the attachment tooth illustrated in FIG. 5.
Figure 7:
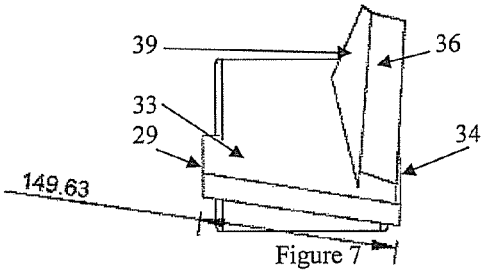
FIG. 7 is a view from the tip of the attachment tooth illustrated in FIG. 4.
Figure 10:
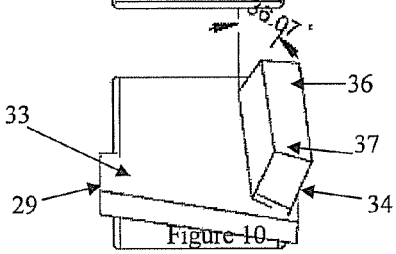
FIG. 10 is a view from the tip of the attachment tooth illustrated in FIG. 5.

As illustrated in FIGS. 6 and 9, the forward edge 29 of the blade member 22 is also angled rearwardly from one sidewall 32 to the opposite side in order to form a leading point 34. Normally, the leading point 34 is located at the intersection of the upper surface 30, a sidewall 32 and the angled forward surface 33 of the blade member 22.

Put another way, the forward surface 33 of the blade member 22 is angled rearwardly and downwardly and also is not perpendicular to the sidewalls 32 of the blade member 22 but instead is angled rearwardly from one sidewall to another.

Further, the lower surface 31 of the blade member 22 is substantially parallel to the upper surface 30 of the blade member 22.

As illustrated, the tooth 20 of the preferred embodiments also have an extension rib 35, standing proud of the upper surface 30 of the blade member 22. The extension rib 35 extends upwardly from a location between one side of the blade member and the midline of the blade member 22.

The extension rib 35 is integrally formed with the blade member 22 with a base portion of the extension rib 35 spaced from the sidewall 32 of the blade member 22. The extension rib has an upper surface 36, a forward surface 37, at least one rear surface 38 and a pair of side surfaces 39.

The extension rib 35 is angled such that the upper surface 36 of the extension rib 35 is offset from the base portion laterally resulting in a portion of the extension rib 35 overhanging the sidewall 32 of the blade member 22. The extension rib 35 extends rearwardly from adjacent the forward edge 29 of the blade member 22 and a rear wall 38 of the extension rib 35 is located above the upper wall 23 of the attachment box 21.

Figure 4:
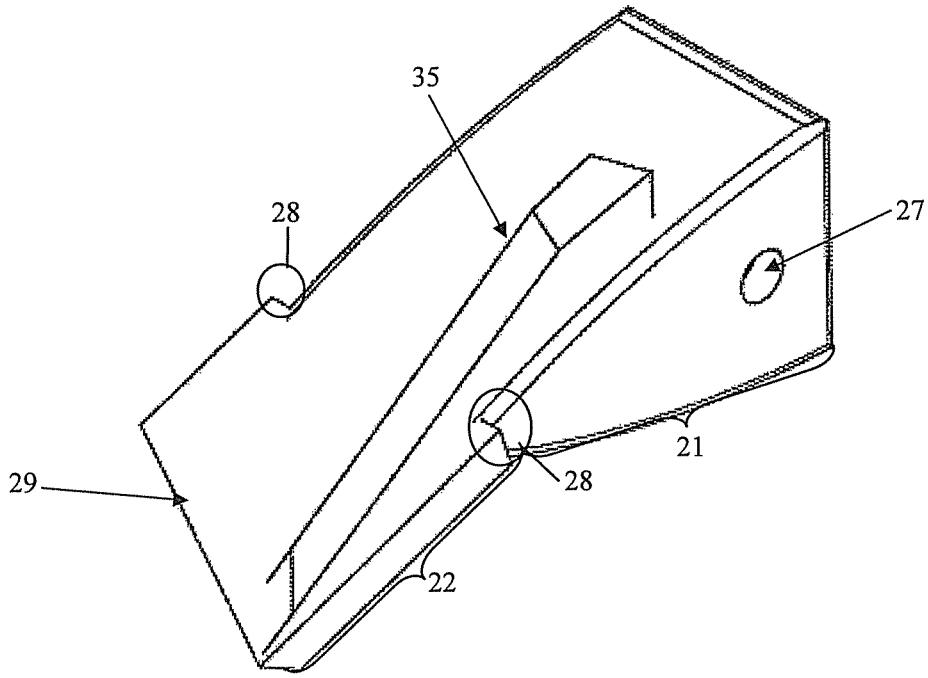
FIG. 4 is a perspective view from the front of an attachment tooth according to a first embodiment configured for hard ground or dirt.
Figure 5:
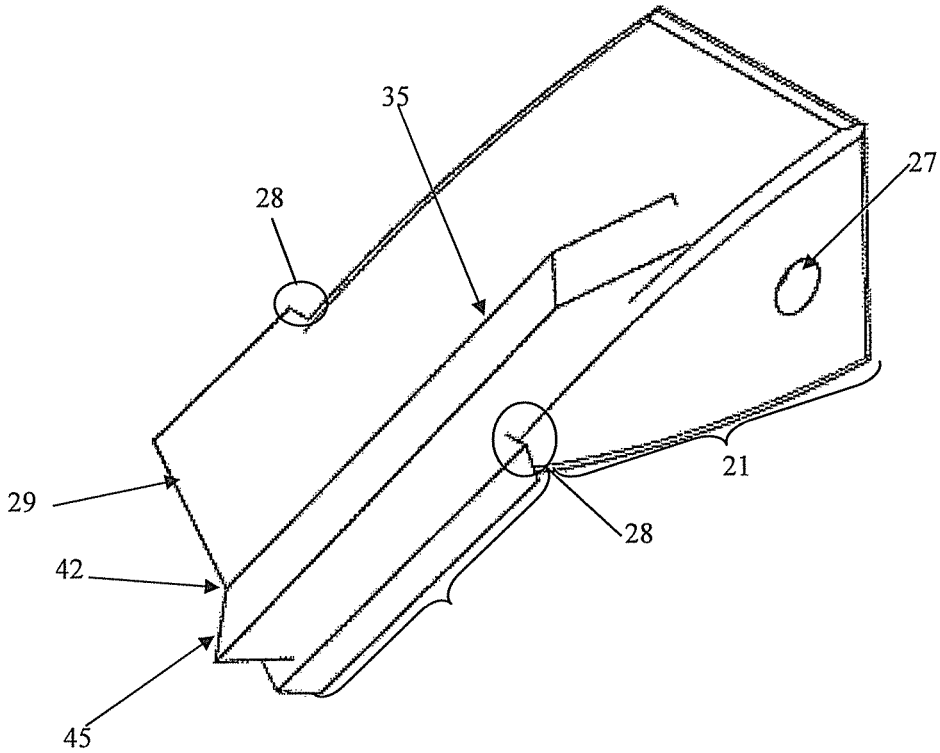
FIG. 5 is a perspective view from the front of an attachment tooth according to a second embodiment configured for ground and tree clearing.

According to alternative preferred embodiment of the present invention, there may be one of two embodiments of extension rib provided which results in the two alternative embodiments of the tooth which are illustrated in FIGS. 4 and 5.

The first preferred embodiment of the tooth 10 illustrated in FIGS. 4, 6 to 8 and 12 to 14 is adapted for use in situations where the tooth is used for dirt and other normal earthmoving and has an extension rib of the first embodiment. The extension rib 35 of this embodiment has an upper surface 36 which is angled with respect to the upper surface 30 of the blade 22, namely the extension rib 35 increases in thickness/height as it extends from the tip of the blade member 22 rearwardly towards the root of the blade member 22.

Accordingly, when viewed from the side (as in FIGS. 12 and 14), the extension rib 35 of this embodiment is wedge-shaped. This extension rib 35 is provided with a pair of faceted rear walls 38, extending in different directions, at different angles.

The upper surface 36 of the extension rib 35 of this embodiment is angled downwardly towards the upper surface 30 of the blade member 22 at the tip end of the rib 35, that angle becoming less prominent towards the rear of the extension rib 35, and more parallel to the upper surface 30 of the blade member, as illustrated in FIG. 12.

Figure 8:
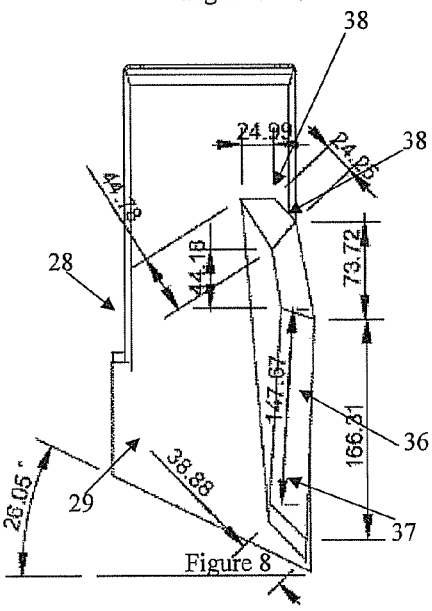
FIG. 8 is a view from above of the attachment tooth illustrated in FIG. 4.
Figure 11:
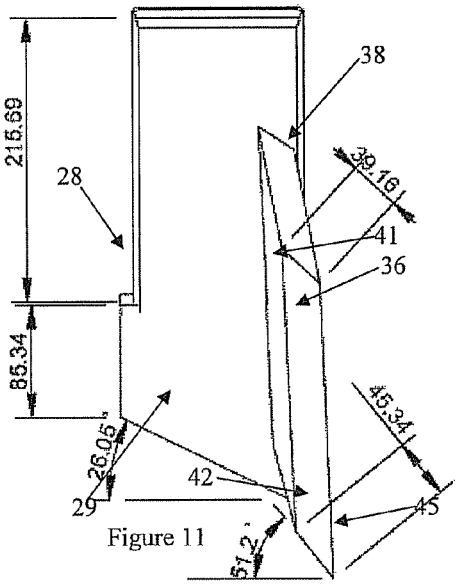
FIG. 11 is a view from above of the attachment tooth illustrated in FIG. 5.
Figure 18:
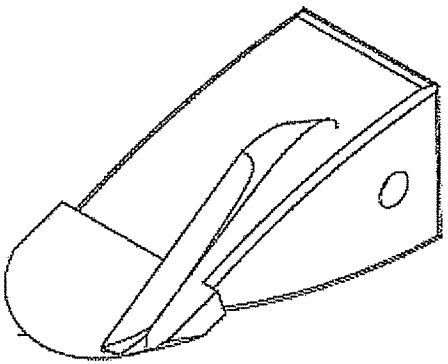
FIG. 18 is a perspective view of the attachment tooth illustrated in FIG. 4 in the worn condition.
Figure 20:
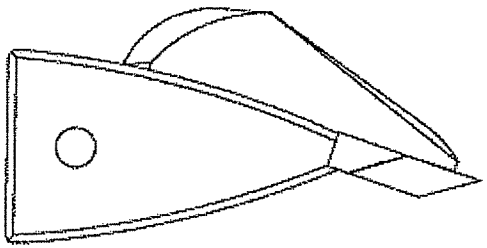
FIG. 20 is a view from one side of the attachment tooth illustrated in FIG. 18.
Figure 19:
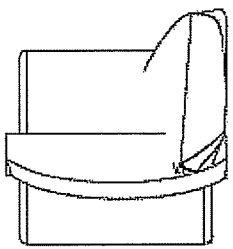
FIG. 19 is a view from the tip of the attachment tooth illustrated in FIG. 18.
Figure 21:
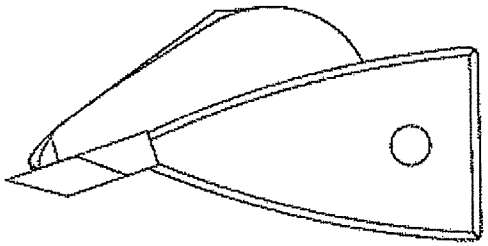
FIG. 21 is a view from the reverse side of the attachment tooth illustrated in FIG. 18.

The rear of the extension rib 35 is spaced further inwardly toward the midline of the blade 22 than the tip of the extension rib 35 as illustrated in FIG. 8. That is, the extension rib 35 extends rearwardly at an angle across the blade.

The extension rib 35 of this embodiment is of substantially uniform thickness.

The second preferred embodiment of the tooth 10 illustrated in FIGS. 5, 9 to 11 and 15 to 17 is adapted for use in situations where the tooth is used earthmoving in situations where it is likely that the tooth will strike trees and other above ground clearable rubble and has an extension rib of a second embodiment. According to this embodiment, the extension rib 35 has a forward surface 37, a rear surface 38, an outer 40 and an inner 41 surface and an upper 36 surface with the base of the extension rib 35 formed integrally with the blade member 22.

As illustrated in FIGS. 15 and 17 particularly, the upper surface 36 of the extension rib 35 of this embodiment is substantially parallel to the upper surface 30 of the blade member 22. Preferably, the upper surface 36 of the extension rib 35 is twisted such that the rear end of the upper surface 36 is angled downwardly towards the upper surface 30 of the blade 22 to a larger degree than the upper surface 36 at the tip end.

The extension rib 35 of this illustrated embodiment is block shaped (rectangular) when viewed from the side. Normally, the rear surface 38 will be angled rearwardly from the upper surface 36 to the attachment box 21. Further, the extension rib 35 of this embodiment is of uniform thickness over its length.

Normally, the tip end of the extension rib 35 of this embodiment is sharpened. The forward edge 42, that is, the edge at the intersection of the forward surface 37 and the upper surface 36 of the extension rib 35 extends forwardly of the forward edge 29 of the blade member 22.

The outer forward edge of the extension rib extends downwardly and rearwardly to the blade member. The inner forward edge is located behind the outer forward edge or closer to the blade member 22. Further, the upper forward edge is located in front of the lower forward edge.

The result of the above edge configurations is that the extension rib 35 of this embodiment forms a forward point 45 and a sharpened, forward, outer edge on the extension rib. Typically, the rear surface 38 of the extension rib 35 of this embodiment is substantially parallel to the forward surface 37.

In FIGS. 18 to 21, a worn tooth of the first preferred embodiment, namely that illustrated in FIGS. 4, 6 to 8 and 12 to 14, is shown. It can be seen that the preferred edge configurations discussed above and the tooth shape in general, has contributed to the tooth retaining its overall shape and particularly the sharpened forward portions.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A wear part including an attachment box with a forwardly extending ground engaging blade member having an upper surface and an extension rib on one side of a midline of the wear part extending upwardly from one lateral side of the upper surface of the blade member with a lower portion of the extension rib spaced from both lateral edges of the ground engaging blade member and extending substantially parallel to the direction of ground engagement over an intersection between the ground engaging blade member and the attachment box.

2. A wear part as claimed in claim 1 wherein the upper surface of the forwardly extending ground engaging blade member is substantially coplanar with an upper surface of the attachment box and a lower surface of the forwardly extending ground engaging blade member is substantially parallel to the upper surface of the forwardly extending ground engaging blade member.

3. A wear part as claimed in claim 1 wherein the attachment box of the wear part has an upper wall, an opposed lower wall and a pair of the sidewalls, the upper and lower walls of the attachment box taper towards each other as they extend towards the blade portion of the wear part.

4. A wear part as claimed in claim 3 wherein the upper and lower walls of the attachment box are arcuate.

5. A wear part as claimed in claim 1 wherein the blade member of the wear part is wider than the attachment box.

6. A wear part as claimed in claim 1 wherein a forward or leading surface of the blade member is angled to provide a sharpened forward edge.

7. A wear part as claimed in claim 6 wherein the forward surface is angled rearwardly from the upper surface of the blade member to a lower surface thereof.

8. A wear part as claimed in claim 6 wherein the forward edge of the blade member is also angled rearwardly from one side of the blade member to the opposite side.

9. A wear part as claimed in claim 1 wherein a lower surface of the blade member is substantially parallel to the upper surface of the blade member.

10. A wear part as claimed in claim 1 wherein the extension rib is integrally formed with the blade member with a base portion of the extension rib spaced from one side of the blade member.

11. A wear part as claimed in claim 1 wherein the extension rib is angled such that an upper surface of the extension rib is offset from the base portion of the extension rib laterally, resulting in a portion of the extension rib overhanging a side of the blade member.

12. A wear part as claimed in claim 1 wherein the extension rib extends rearwardly from adjacent a forward edge of the blade member to a rear wall of the extension rib located above the attachment box.

13. A wear part as claimed in claim 1 wherein the extension rib increases in thickness/height as it extends from a tip of the blade member towards the rear of the blade member.

14. A wear part as claimed in claim 1 wherein the extension rib is provided with one or more faceted rear walls extending in different directions, at different angles.

15. A wear part as claimed in claim 13 wherein an upper surface of the extension rib is angled downwardly towards the upper surface of the blade member at the tip end, the angle tapering towards the rear of the extension rib in relation to the upper surface of the blade member.

16. A wear part as claimed in claim 13 wherein the extension rib extends rearwardly at an angle across the blade member.

17. A wear part as claimed in claim 1 wherein the extension rib is substantially rectangular having a forward surface, a rear surface, an outer and an inner surface and a top surface with the base of the extension rib formed integrally with the blade member.

18. A wear part as claimed in claim 17 wherein the upper surface of the extension rib is twisted such that the rear end of the upper surface is angled downwardly towards the upper surface of the blade to a larger degree than the upper surface at the tip end.

19. A wear part as claimed in claim 17 wherein a forward edge at the intersection of the forward surface and the upper surface of the extension rib extends forwardly of the forward edge of the blade member.

20. A wear part as claimed in claim 17 wherein an outer forward edge of the extension rib extends downwardly and rearwardly to the blade member, an inner forward edge is located behind the outer forward edge and an upper forward edge is located in front of a lower forward edge.

21. A wear part as claimed in claim 17 wherein the extension rib forms a forward point and a sharpened, forward, outer edge on the extension rib.

22. A wear part as claimed in claim 17 wherein the rear surface of the extension rib is substantially parallel to the forward surface.

* * * * *